United States Patent [19]

Jones

[11] Patent Number: 4,611,354

[45] Date of Patent: Sep. 16, 1986

[54] HAIR SHAMPOO FACE AND BODY SHIELD

[76] Inventor: Virginia C. Jones, 4363 E. Montclair Cir., Mobile, Ala. 36609

[21] Appl. No.: 694,145

[22] Filed: Jan. 23, 1985

[51] Int. Cl.[4] ..... A45D 44/08

[52] U.S. Cl. ..... 2/174; 2/50

[58] Field of Search ..... 132/1 R, 9; 2/12, 48, 2/50, 174; D28/9, 99

[56] References Cited

U.S. PATENT DOCUMENTS

| | | | |
|---|---|---|---|
| 986,728 | 3/1911 | Lee | 2/174 |
| 1,062,497 | 5/1913 | Parkhurst | 2/50 |
| 1,905,370 | 4/1933 | Dorsey et al. | 2/174 |
| 2,296,078 | 9/1942 | Young | 2/174 |
| 2,389,596 | 11/1945 | Charnas et al. | 2/50 |
| 2,413,456 | 12/1946 | Larkin | 2/174 |
| 2,552,803 | 5/1951 | McGee | 2/174 |
| 2,851,690 | 9/1958 | Jennings | 2/50 |
| 2,987,730 | 6/1961 | Walker | 2/174 |
| 4,133,052 | 1/1979 | Hodgman et al. | 2/174 |

*Primary Examiner*—Paul J. Hirsch

*Attorney, Agent, or Firm*—Harvey B. Jacobson

[57] ABSTRACT

A face and body shield is provided for persons having their hair shampooed. The shield includes a flexible and at least water impervious panel including opposite upper and lower margins and opposite side margins extending between corresponding ends of the upper and lower margins. The upper margin includes at least a central portion thereof which is outwardly convex curved and includes first stiffening structure extending therealong. A generally circular opening is formed in the panel adjacent and spaced inwardly of the central portion of the upper margin and the marginal edges of the panel defining the opening are gathered and have an elongated elastic strip anchored relative thereto and extending therealong. In addition, second stiffening structure is carried by the panel between the marginal portions thereof defining the adjacent portions of the central portion of the upper marginal edge and the aforementioned opening.

5 Claims, 4 Drawing Figures

HAIR SHAMPOO FACE AND BODY SHIELD

BACKGROUND OF THE INVENTION

Field of the Invention

This invention relates to an article of apparel and more specifically to a guard or protector to be worn about the head of the user for the purpose of shielding the face against water and soap being used to shampoo the hair of the user.

DESCRIPTION OF RELATED ART

Various different forms of wearing apparel in the form of shields to be supported from or about the head of a user and for the purpose of shielding the face of the user heretofore have been provided such as those disclosed in U.S. Pat. Nos. 986,728, 1,660,124, 2,413,456, 2,552,803 and 2,637,853.

SUMMARY OF THE INVENTION

The shield of the instant invention includes a flexible and at least water repellent panel including opposite upper and lower margins and opposite side margins extending between corresponding ends of the upper and lower margins. The upper margin includes at least a central portion thereof which is outwardly convex curved and includes first stiffening structure extending therealong. A generally circular opening is formed in the panel and spaced inwardly of and adjacent the outwardly convex curved central portion of the upper margins. The marginal edges of the panel defining the opening are gathered and have elastic means anchored relative thereto and extending therealong. A second stiffening structure is carried by the panel between the marginal portions thereof defining the adjacent portions of the opening and convex curved central upper marginal portion.

The portion of the panel defining the opening may be slipped over the rear portion of the head of the user with the hair of the user pulled rearwardly through the opening for shampooing. In this manner, the elastic equipped marginal edges of the panel defining the opening therethrough may tightly grip the skin surface of the user's head forward of the roots of the hair on the upper and side portions of the user's head and below the roots of the hair on the rear lower portion of the user's head.

The main object of this invention is to provide a shield for shielding face and clothing of a person having his or her hair shampooed. The shield is designed to function in a manner to prevent water and/or soap from flowing over the face of the user, down the neck of the user and onto the clothes of the user.

Another object of this invention is to provide a shield in accordance with the preceding objects and which may be inexpensively produced for one time usage.

A still further object of this invention is to provide a shield constructed in a manner whereby it may be readily used in conjunction with different size people and in conjunction with persons having different types of hair.

A further object of this invention is to provide a shield which also may be used for treating the user's hair during various hair treatment operations which may be carried out in a beauty salon or barber shop.

A final object of this invention to be specifically enumerated herein is to provide a shield in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
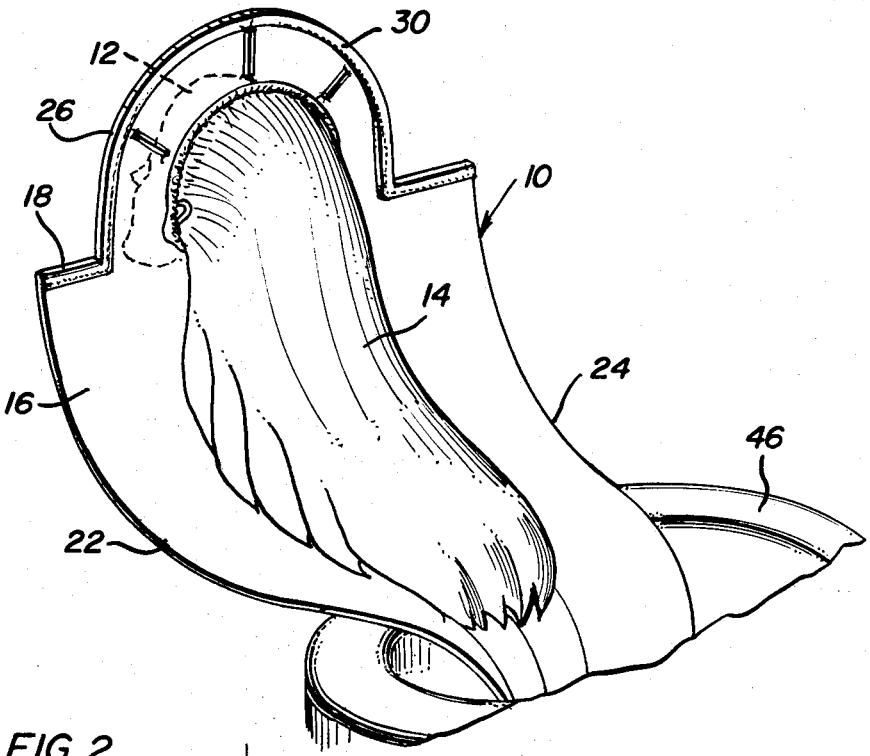
FIG. 1 is a perspective view of the shield as applied to a user's head and for the purpose of functioning as a shield during a shampooing operation to be carried out on the user's head.

Referring now more specifically to the drawings the numeral 10 generally designates the shield of the instant invention. The shield is illustrated in FIG. 1 as applied to the rear portion of the head of a user 12 with long hair 14 of the user pulled rearwardly through an opening formed in the shield.

Figure 3:
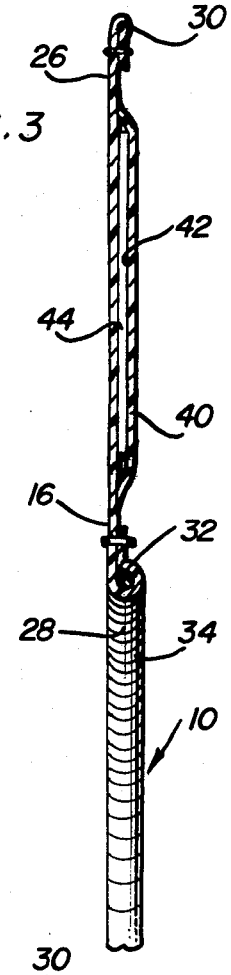
FIG. 3 is a vertical sectional view taken substantially upon the plane indicated by the section line 3—3 of FIG. 2.
Figure 2:
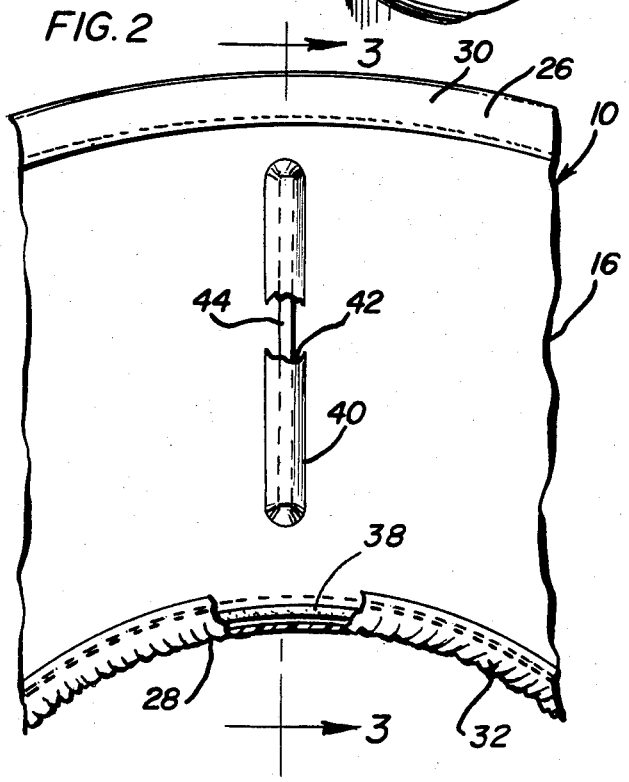
FIG. 2 is an enlarged fragmentary elevational view of the upper marginal portion of the shield.
Figure 4:
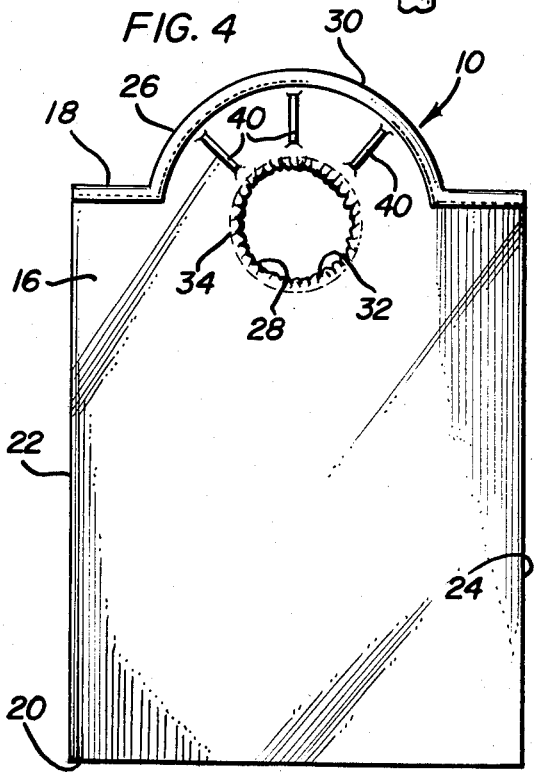
FIG. 4 is a plan view of the shield.

With attention now invited more specifically to FIGS. 2, 3 and 4 of the drawings, the shield 10 comprises a panel 16 of any suitable flexible and at least water repellent (preferably water impervious) material. The panel 16 includes upper and lower marginal portions 18 and 20 interconnected by opposite side marginal portions 22 and 24 extending between corresponding ends of the marginal portions 18 and 20.

It will be noted that the panel 16 is generally rectangular in plan shape and that the marginal portions 22 and 24 comprise the longer marginal portions. However, the upper marginal portion 18 includes at least an outwardly convex curved central portion 26 and the panel 16 includes an opening 28 formed therein spaced inward of and adjacent the central portion 26. The center of the opening 28 may coincide with the center of curvature of the central portion 26, if desired.

The marginal portion 18 is reinforced throughout its length (including the central portion 26) by a hem 30 extending fully along the marginal portion 18 and the hem 30 functions to stiffen the marginal portion 18.

The marginal portions of the panel 16 defining and extending about the opening 28 are gathered as at 32 and have elastic means 34 secured thereto. In this manner, the size of the opening 28 may be increased so as to receive the rear portion of the head of the user 12 therethrough with the gathered marginal portions 32 of the panel 16 defining the opening 28 tightly engaged with the head of the user.

The elastic means 34 comprises an elastic strip 38 secured to and extending at least substantially fully about the gathered marginal portions 32. Further, the panel 16 includes elongated areas 40 thereof disposed generally along radii of the center of curvature of the central portion 26. The elongated areas 40 are disposed between the central portion 26 and the corresponding marginal portions 32 of the opening 28. The areas 40 define elongated pockets 42 in which elongated stiffening members 44 are captively retained. The stiffening members 44, together with the hem 30 serve to stiffen the upper portion of the panel 16 in a manner which is believed to be obvious from FIG. 1 of the drawings.

In use, the rear portion of the head of the user 12 is received through the opening 28 after the latter has been at least slightly increased in size sufficiently to slip over the user's head and the hair 14 of the user 12 is pulled through the opening 28. In this manner, substantially all of the hair of the user 14 is disposed on the side of the lower portion of the panel 16 remote from the side thereof opposing the back of the user 12 and the facial surfaces of the user 12 are disposed on the side of the panel member 22 remote from the hair 14. Once the shield 10 has been placed in position in the manner illustrated in FIG. 1 of the drawings with the lower marginal portion 20 of the shield 10 disposed within a nearby sink or other receptacle 46, the hair 14 of the user 12 may be shampooed without any water and/or soap flowing downwardly over the face of the user 12, down the neck of the user 12 or over the clothes of the user 12.

The shield 10 preferably is constructed of lightweight plastic material so that it may be inexpensively produced and disposed of after it has been used once. Further, if it is desired, the marginal portion 18 may also include a stiffening member, or members, similar to the stiffening members 44 and disposed within the hem 30.

Of course, the shield 10 may be compactly folded or rolled for ease in shipment and/or storage and the gathered marginal edge 32 defining the opening 28 as well as the elastic means 34 enable the rear of substantially any size head to be received through the opening 28.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A face and body shield for persons having their hair shampooed, said shield including an elongated flexible and at least water repellent panel including opposite first and second transverse end margins and opposite side longitudinal margins extending between corresponding ends of said first and second transverse margins, said first transverse margin including at least a central portion thereof which is outwardly convex curved and includes first stiffening means extending therealong, said panel including a substantially circular opening formed therein spaced inwardly of said first margin central portion, the marginal edges of said panel extending about and defining said opening being gathered and having elastic means anchored relative thereto and extending therealong, and second stiffening means carried by the portion of said panel disposed between said central portion of said upper margin and the adjacent portions of said marginal edges extending about said opening, said second stiffening means including elongated areas of said panel disposed generally along radii of the center of said opening, said elongated areas including elongated stiffening members supported therefrom.

2. The shield of claim 1 wherein said panel comprises a water impervious panel.

3. The shield of claim 1 wherein said elastic means comprises an elastic strip extending at least substantially fully about said opening and to which the gathered marginal edges of said panel defining said opening are secured.

4. The shield of claim 1 wherein said central portion is spaced inward from the adjacent ends of said side margins and thus is spaced inwardly of the ends of said upper margin.

5. The shield of claim 1 wherein said first stiffening means includes a hem formed on and extending at least substantially fully along said upper margin.

* * * * *